United States Patent [19]

Moly

[11] Patent Number: 4,998,889

[45] Date of Patent: Mar. 12, 1991

[54] ELECTRICAL CONNECTOR

[75] Inventor: José Moly, Gratentour, France

[73] Assignee: Labinal S.A., Montigny Le Bretonneux, France

[21] Appl. No.: 426,684

[22] Filed: Oct. 26, 1989

[30] Foreign Application Priority Data

Oct. 26, 1988 [FR] France ..... 8813984

[51] Int. Cl.[5] ..... H01R 13/629

[52] U.S. Cl. ..... 439/247; 439/248

[58] Field of Search ..... 439/246–249

[56] References Cited

U.S. PATENT DOCUMENTS 4,156,551 5/1979 Nagase et al. ..... 339/15
4,647,129 3/1987 Kandybowski et al. ..... 439/236
4,812,133 3/1989 Fleak et al. ..... 439/248

FOREIGN PATENT DOCUMENTS 0147828 7/1985 European Pat. Off. .

*Primary Examiner*—Eugene F. Desmond
*Attorney, Agent, or Firm*—Sandler, Greenblum & Bernstein

[57] ABSTRACT

An electrical connector comprises a molded plastics material female housing member incorporating a skirt and a molded plastics material male housing member adapted to be inserted into this skirt. Guides on one housing member align the male and female housing members during insertion of the male housing member into the skirt. There are multiple channels in each housing member. Those in one housing member are adapted to receive male electrical connection members and those in the other housing member are adapted to receive corresponding female electrical connection members. At least one housing member is joined to a support by corrugated elastic strips, so that it can oscillate in the support.

26 Claims, 4 Drawing Sheets

ELECTRICAL CONNECTOR

BACKGROUND OF THE INVENTION

1. Field of the Invention

The present invention is directed to electrical connectors comprising a male housing member and a corresponding female housing member, one of these housing members containing male electrical connection members and the other containing corresponding female electrical connection members.

2. Description of the Prior Art

Connectors of this kind are very well known and routinely used in many industries, in particular in the manufacture of automobiles, aircraft, domestic appliances, etc.

In principle, one housing member supports a series of male electrical connection members connected to a set of conductors for supplying various electrical devices and the other housing member supports a series of female electrical connection members corresponding to the male members and connected to a set of conductors to ensure continuity of electrical supply from the current source to the devices to be supplied. Once the housing members are assembled together, there is in principle no need to uncouple them. In some applications, however, it must be possible to separate and reassemble the housing members many times, one of them being carried by a part that is mobile relative to a part carrying the other. As some slack may arise between these parts, it may become impossible to insert the male member into the female member because they are no longer aligned.

In mechanized installations where robots assemble the housing members the situation can arise that, because of the tolerances, the housing members are offset and so cannot be assembled together.

One object of the present invention is to provide an electrical connector in which the male housing member can be inserted into the female housing member even if the housing members are not in perfect alignment.

SUMMARY OF THE INVENTION

In one aspect, the present invention consists in a molded plastics material housing for an electrical connector comprising a female housing member incorporating a skirt, a male housing member adapted to be inserted into said skirt, guide means on one housing member for aligning said male and female housing members during insertion of said male housing member into said skirt, multiple channels in each housing member of which those in one housing member are adapted to receive male electrical connection members and those in the other housing member are adapted to receive corresponding female electrical connection members, a support for at least one of said housing members and corrugated elastic strips joining said at least one housing member to said support so that it can oscillate therein.

In another aspect, the present invention consists in an electrical connector comprising a molded plastics material female housing member incorporating a skirt, a molded plastics material male housing member adapted to be inserted into said skirt, guide means on one housing member for aligning said male and female housing members during insertion of said male housing member into said skirt, multiple channels in each housing member, respective male electrical connection members in said channels of one housing member, respective corresponding female electrical connection members in said channels of the other housing member, a support for at least one of said housing members and corrugated elastic strips joining said at least one housing member to said support so that it can oscillate therein.

The at least one housing member, the support and the elastic strips are preferably molded from the plastics material in one piece.

There may be means on the support for fixing it into an opening in a holding member.

In a preferred embodiment the support is in the form of a frame and the corrugated elastic strips are inserted between a side wall of the at least one housing member and an internal side wall of the frame.

In this preferred embodiment, the at least one housing member may be parallelepiped-shaped, the support may have a corresponding shape and the corrugated elastic strips may extend between outer corners of the at least one housing member and inner corners of the support.

Alternatively, the at least one housing member may be parallelepiped-shape, the support may have a corresponding shape and there may be two corrugated elastic strips extending between mid-points of respective opposite side walls of the at least one housing member and the corresponding internal side walls of the support.

These corrugated elastic strips may be V-shape with two branches of unequal length, the shorter branch being joined to the at least one housing member.

The guide means preferably comprise a flared extension of the skirt.

Alternatively, the guide means may comprise fingers on one housing member and corresponding bushes on the other housing member.

In this case, the fingers may have conical ends.

The fingers and the conical ends may be defined by ribs disposed radially to an axis passing through the tips of the conical ends.

Abutment members may be provided for limiting movement of the at least one housing member in the support.

The support may be in the form of a frame with corrugated elastic strips on an inside surface of the frame and a plate joined to the frame by the corrugated strips and comprising means for attaching the at least one housing member.

This plate may comprise fingers and the at least one housing member comprise bushes adapted to cooperate with these fingers.

The invention will now be described in more detail and by way of example only with reference to specific embodiments shown in the appended drawings.

DESCRIPTION OF THE PREFERRED EMBODIMENTS

Figure 1:
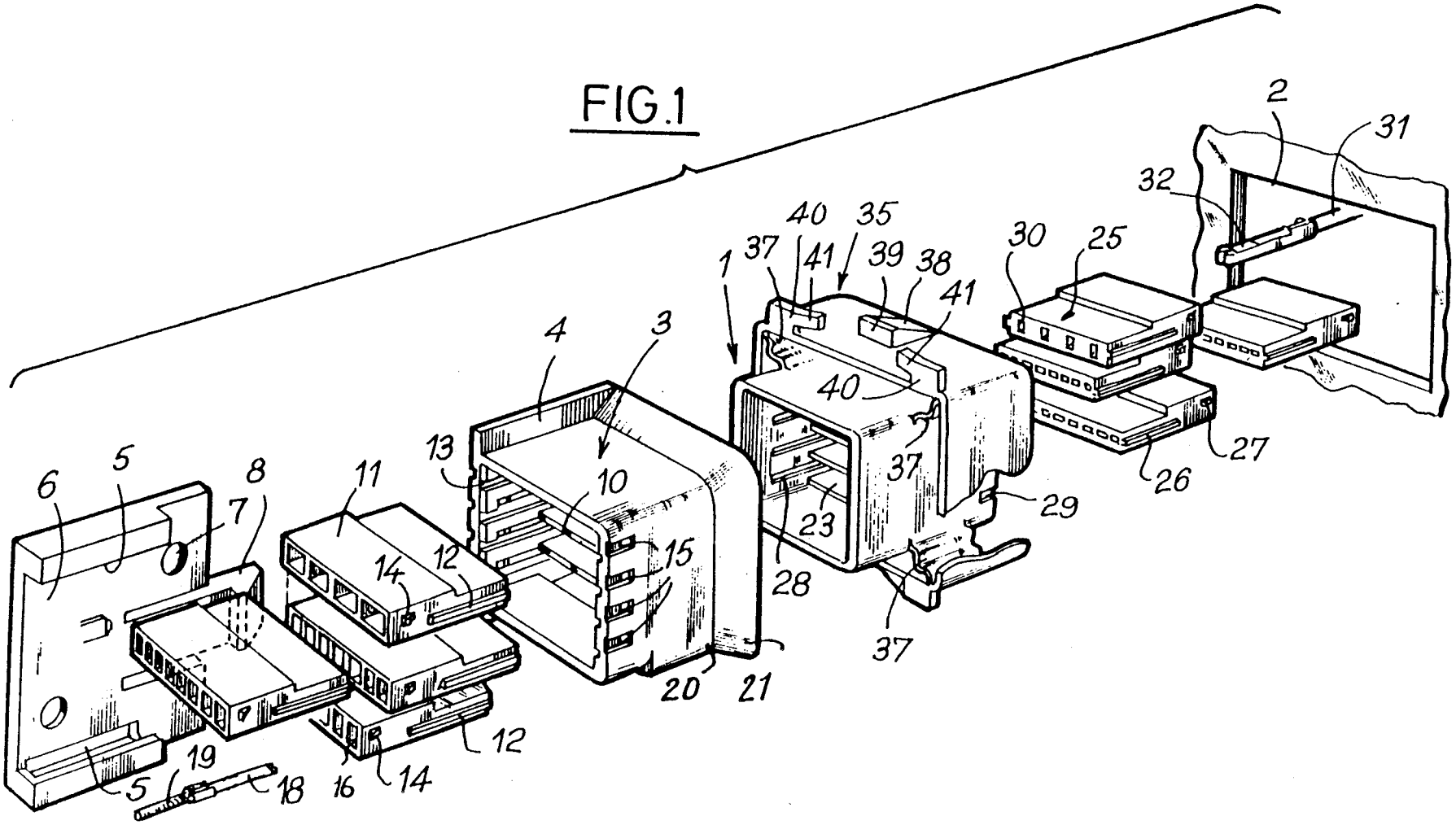
FIG. 1 is an exploded perspective view of an electrical connector in accordance with the invention.

FIG. 1 shows a male housing member 1 which is adapted to be fixed into an opening 2 in a mobile member and a female housing member 3 provided with lateral rims 4 constituting a slide adapted to be inserted into grooves 5 in a fixing part 6 in which there are holes 7 so that it can be screwed to a fixed member. The part 6 is provided with a resilient hook 8 for locking the member 3 in place when inserted into the grooves 5.

Of course, the part 6 could be mounted on a mobile member with the member 1 carried by a fixed part, or both members 1 and 3 could be carried by movable parts.

The female housing member 3 is generally parallelpiped-shape and comprises internally three bars 10 which define four compartments each adapted to receive a contact housing 11. The contact housings 11 comprise a lateral tang 12 adapted to cooperate with grooves 13 in the compartments and pegs 14 adapted to be inserted into holes 15 in the side walls of the female member to lock the contact housings 11 in place.

In this embodiment the contact housings 11 are divided into a number of channels 16 each adapted to receive a respective flat male electrical contact member 18 connected to an electrical conductor 19, said members 18 projecting from the corresponding end of the contact housings 11.

On the side into which the male member 1 is inserted the female housing member 3 has a skirt 20 ending in a flared part 21 constituting guide means.

The male member 1 is generally parallelepiped-shape and comprises internally three bars 23 defining compartments each adapted to receive a contact housing 25 provided with lateral tangs 26 adapted to cooperate with grooves 28 in the male member 1 and pegs 27 on the sides of the contact housings adapted to be inserted into holes 29 in said male member 1 to lock said contact housings 25 in place.

Each contact housing 25 comprises a series of channels 30 corresponding in number to the channels of the contact housings 11 and each adapted to receive a female electrical contact member 32 connected to an electrical conductor 31.

The male housing member 1 is joined to a support 35 in the form of a substantially rectangular frame by corrugated strips 37.

The support 35 comprises, on each of two opposite sides, a ramp 38, ending abruptly at a steep face 39 and two lugs 40 each provided with an extension 41 inclined towards the steep face 39.

The male housing member 1, the support 35 and the corrugated strips 37 are molded in one piece from an electrically insulative plastics material featuring some resilience.

When the support 35 is placed in the opening 2 the ramps 38 retract resiliently by virtue of elastic deformation of the corresponding walls of the support and then return to their initial position on passing beyond the plane of the opening, the steep face 39 bearing on one side of the mobile member whereas the extensions 41 bear against the opposite side.

The strips 37 extend between the outside corners of the male member 1 and the inside corners of the support 35. Because of the corrugations that they incorporate the housing member 1 is able to oscillate slightly in all directions so that if it is slightly offset when offered up to the female member it can be guided into realignment by the flared part 21 and inserted into the skirt 20. The invention may equally well be implemented by mounting the female housing member 3 in a support like the support 35 with interposed corrugated elastic strips 37.

Figure 4:
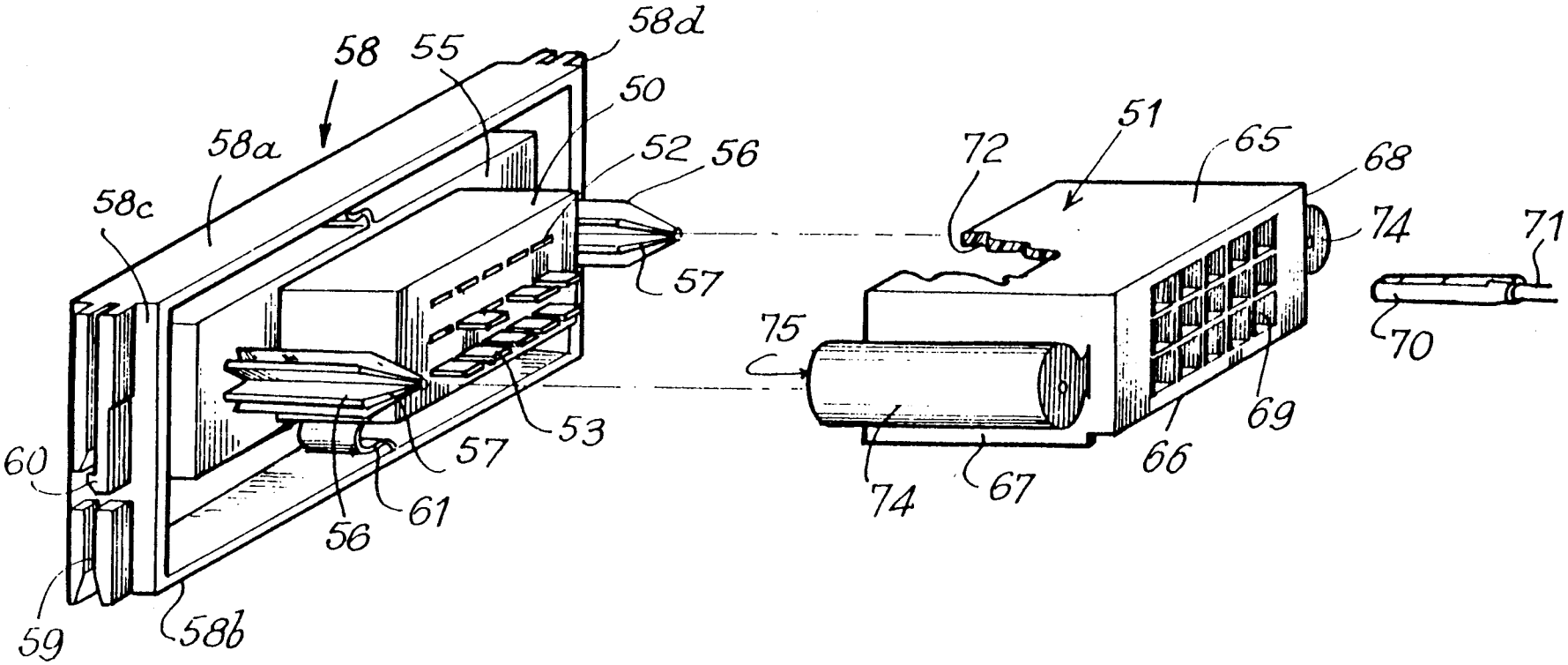
FIG. 4 is an exploded perspective view of another embodiment of the invention.
Figure 2:
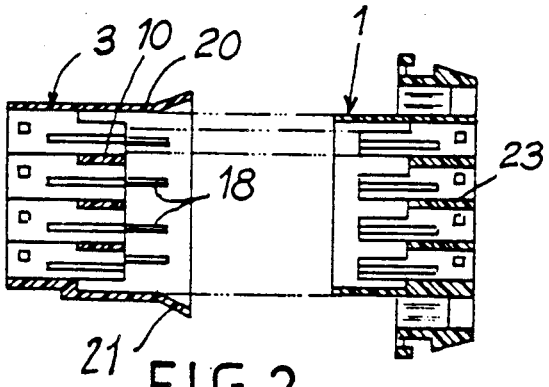
FIG. 2 is a view of the connector from FIG. 1 in cross-section.
Figure 3:
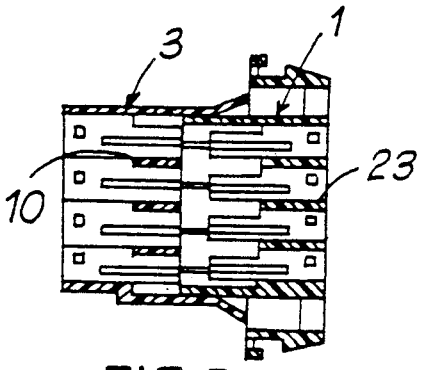
FIG. 3 is a view similar to FIG. 2 showing the housing members assembled together.
Figure 5:
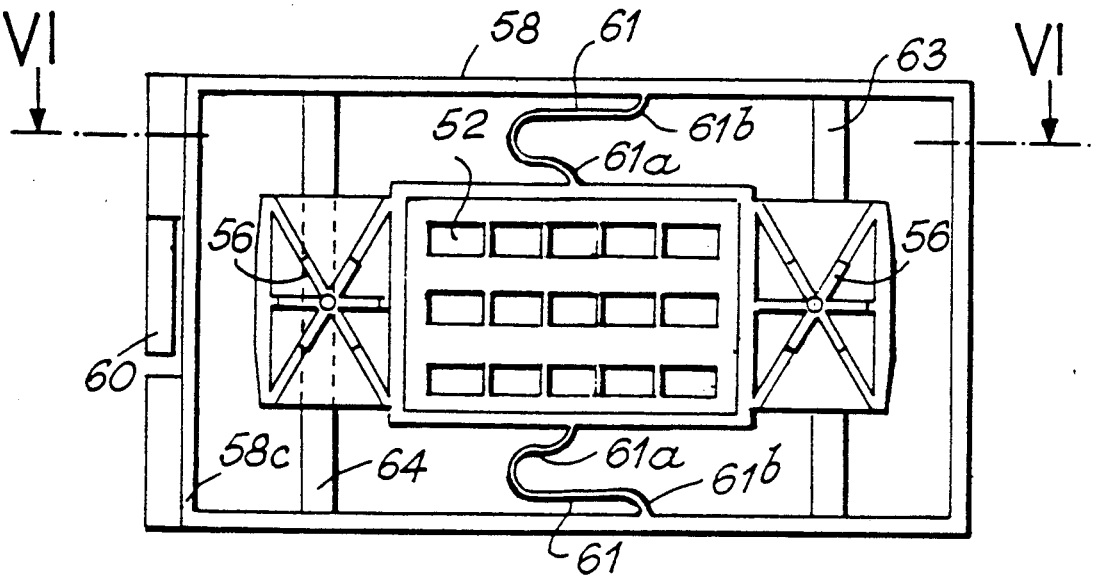
FIG. 5 is a view in front elevation of one of the housing members from FIG. 4.
Figure 6:
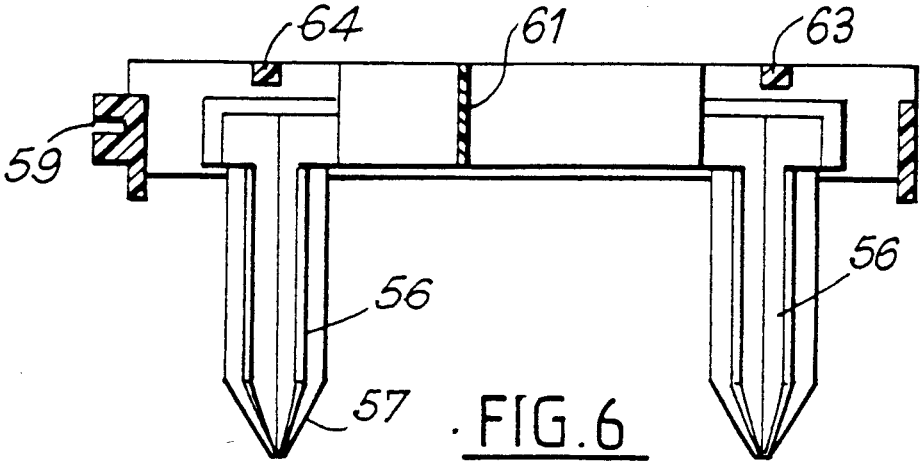
FIG. 6 is a view in cross-section on the line VI—VI in FIG. 5.

FIGS. 4, 5 and 6 show another embodiment in which the connector housing comprises a male housing member 50 and a female housing member 51.

The male housing member 50 comprises a series of channels 52 in which are accommodated male electrical connection members 53, of the same type as the members 18, for example, connected to conductors and projecting from the corresponding end of the member 50.

The housing member 50 is fixed to a plate 55 comprising two fingers 56 the free ends of which terminate in a cone 57. The plate 55 is accommodated in a support 58 in the form of a rectangular frame having two longer sides 58*a*, 58*b* and two shorter sides 58*c*, 58*d* and comprising on the shorter sides 58*c* and 58*d* lateral grooves 59 for mounting it in a slot in a metal plate, for example. One of the grooves comprises a peg 60 adapted to be inserted into a hole in the plate to lock the assembly.

The fingers 56 are formed by ribs disposed radially to an axis passing through the tip of the cone 57.

The plate 55 is joined to the support 58 by two elastic strips 61.

Each elastic strip 61 is V-shape with one branch 61*a* connected to a mid-point on the plate 55 and a longer branch 61*b* joined to the corresponding side of the frame 58, the points at which the branches 61*b* are joined to the inside of the sides 58*a* and 58*b* being offset so as to be nearer the shorter side 58*d* than the shorter side 58*c*.

The plate 55 is therefore able to oscillate. Abutment members 63 and 64 are provided in line with the fingers 56, however, to limit the displacement of the plate,outside the plane of the frame 58. These abutment members are in the form of bars extending between the sides 58*a* and 58*b* parallel to the shorter sides 58*c* and 58*d*.

The support 58, the plate 55, the elastic strips 61, the fingers 56 and the male housing member 50 are molded in one part from the plastics material.

The female housing member 51 is molded from the plastics material and has a generally parallelepiped-shape body with two longer sides 65 and 66 and two shorter sides 67 and 68.

The rear surface of the body features a series of channels 69 corresponding to the channels 52 and each adapted to contain a female electrical connection member 70 connected to a flexible conductor 71. The front surface is extended by a skirt 72 adapted to receive the male housing member 50.

The lateral sides 67 and 68 each comprise a bush 74 in which is a cylindrical blind hole 75 opening onto the front surface of the housing member 51, the diameter of the blind hole 75 being adapted to receive the finger 56.

When the two housing members 50 and 51 are offered up to each other in order to place the male member 50 in the skirt 72 the tips of the cones 57, which project relative to said member 50, cooperate with the edge of the openings of the blind holes 75 and serve to align the two housing members which can therefore be inserted the one within the other. The fingers 56 are carried by the plate 55 fixed to the male housing member 50 and the bushes 74 by the female housing member 51. A different arrangement would be equally feasible, for example with the bushes 74 on the male housing member 50 and the fingers on the female housing member 51 or a finger 56 and a bush 74 on the male housing member 50 and a finger 56 and a bush 74 on the female housing member 51.

Provision could be made for the female housing member 51 to be mounted in a support 58 with interposed corrugated elastic strips 61, the male housing member 50 being in a support 58 or not.

Figure 7:
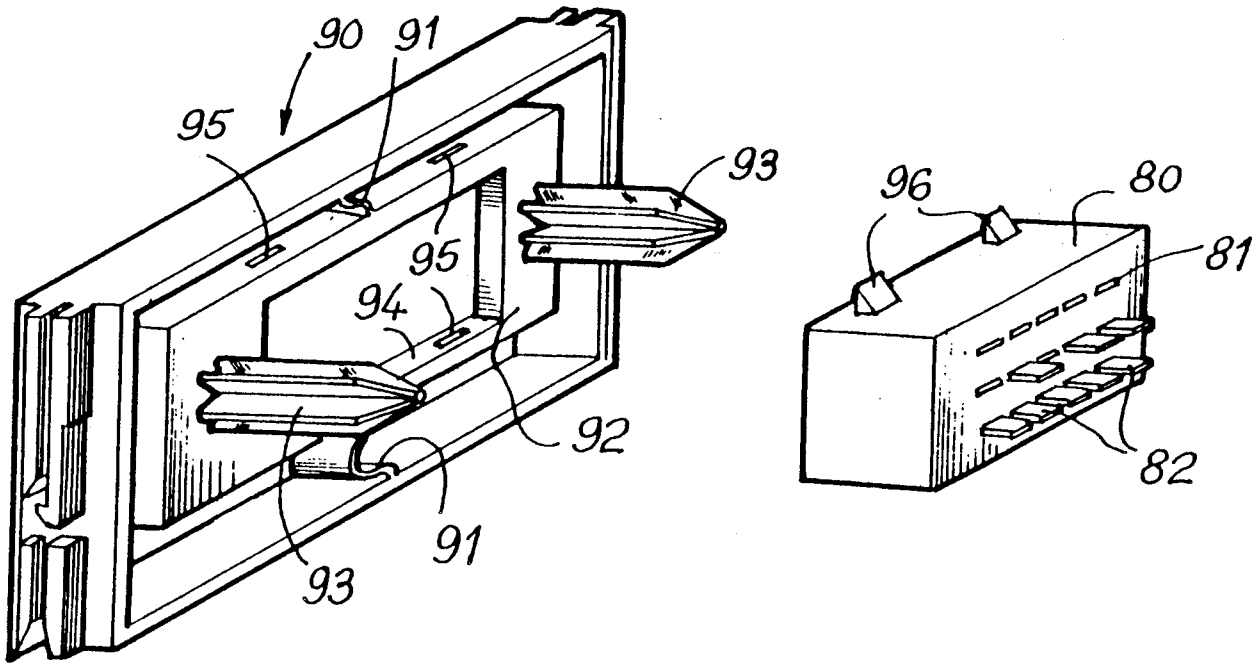
FIG. 7 is an exploded perspective view of a further embodiment of the invention.

FIG. 7 shows a further embodiment of the invention in which the male housing member 80 is in the form of an independent member with channels 81 in which are accommodated male electrical connection members 82.

The female housing member is not shown in this FIGURE. It is the same as the member 51 from FIG. 4.

The member 80 is adapted to be fixed to a support 90 which is of the same type as the support 58 (FIG. 4) and is provided with two elastic strips 91 joined to a plate 92 provided with fingers 93.

The plate 92 has a central opening 94 and on two opposed sides perforations 95 adapted to receive corresponding pegs 96 of the member 80. Thus slight elastic deformation of the plate 92 allows the latter to be fastened to the member 80.

It is therefore possible, using the same support 90 and the same plate 92, to mount male housing members 80 having the same external shape but different internal arrangements, for example larger or smaller channels, a larger or smaller number of channels, and so on.

Of course, the invention is not limited to the embodiments that have just been described and shown. Numerous modifications of detail may be made thereto without departing from the scope of the invention.

There is claimed:

1. Molded plastics material housing for an electrical connector comprising:

a female housing member incorporating a skirt;

a male housing member adapted to be inserted into said skirt;

guide means on one of said male and female housing members for aligning said male and female housing members during insertion of said male housing member into said skirt;

multiple channels in each of said male and female housing members of which those in one housing member are adapted to receive male electrical connection members and those in the other housing member are adapted to receive corresponding female electrical connection members;

a support for at least one of said male and female housing members;

corrugated elastic strips joining said at least one housing member to said support so that it can oscillate therein; and said at least one housing member, said support and said elastic strips being molded in one piece from said plastics material.

2. Housing according to claim 2 further comprising means on said support for fixing it into an opening in a holding member.

3. Housing according to claim 2 wherein said support is in the form of a frame and said corrugated elastic strips are inserted between a side wall of said at least one housing member and an internal side wall of said frame.

4. Housing according to claim 1 wherein said guide means comprise a flared extension of said skirt.

5. Housing according to claim 1 wherein said guide means comprise fingers on one housing member and corresponding bushes on the other housing member.

6. Housing according to claim 5 wherein said fingers have conical ends.

7. Molded plastics material housing for an electrical connector comprising:

a female housing member incorporating a skirt;

a male housing member adapted to be inserted into said skirt;

guide means on one of said male and female housing members for aligning said male and female housing members during insertion of said male housing member into said skirt;

multiple channels in each of said male and female housing members of which those in one housing member are adapted to receive male electrical connection members and those in the other housing member are adapted to receive corresponding female electrical connection members;

a support for at least one of said male and female housing members being in the form of a frame;

corrugated elastic strips joining said at least one housing member to said support so that it can oscillate therein, with said corrugated elastic strips being inserted between a side wall of said at least one housing member and an internal side wall of said frame; and said at least one housing member being of a parallelpiped-shape, said support having a corresponding shape and said corrugated elastic strips extending between outer corners of said at least one housing member and inner corners of said support.

8. Molded plastics material housing for an electrical connector comprising:

a female housing member incorporating a skirt;

a male housing member adapted to be inserted into said skirt;

guide means on one of said male and female housing members for aligning said male and female housing members during insertion of said male housing member into said skirt;

multiple channels in each of said male and female housing members of which those in one housing member are adapted to receive male electrical connection members and those in the other housing member are adapted to receive corresponding female electrical connection members;

a support for at least one of said male and female housing members being in the form of a frame;

corrugated elastic strips joining said at least one housing member to said support so that it can oscillate therein, with said corrugated elastic strips being inserted between a side wall of said at least one housing member and an internal side wall of said frame; and said at least one housing member being of a parallelpiped-shape, said support having a corresponding shape and there being two corrugated elastic strips extending between mid-points of respective opposite side walls of said at least one housing member and the corresponding internal side walls of said support.

9. Housing according to claim 8 wherein said corrugated elastic strips are V-shape with two branches of unequal length, the shorter branch being joined to said at least one housing member.

10. Housing according to claim 9 further comprising abutment members for limiting movement of said at least one housing member in said support.

11. Molded plastics material housing for an electrical connector comprising:

a female housing member incorporating a skirt;

a male housing member adapted to be inserted into said skirt;

guide means on one of said male and female housing members for aligning said male and female housing members during insertion of said male housing member into said skirt;

multiple channels in each of said male and female housing members of which those in one housing member are adapted to receive male electrical connection members and those in the other housing member are adapted to receive corresponding female electrical connection members;

a support for at least one of said male and female housing members;

corrugated elastic strips joining said at least one housing member to said support so that it can oscillate therein; and said guide means comprising fingers on one of said housing members and corresponding bushes on the other of said housing members, said fingers having conical ends, said fingers and conical ends being defined by ribs disposed radially to an axis passing through tips of said conical ends.

12. Molded plastics material housing for an electrical connector comprising:

a female housing member incorporating a skirt;

a male housing member adapted to be inserted into said skirt;

guide means on one of said male and female housing members for aligning said male and female housing members during insertion of said male housing member into said skirt;

multiple channels in each of said male and female housing members of which those in one housing member are adapted to receive male electrical connection members and those in the other housing member are adapted to receive corresponding female electrical connection members;

a support for at least one of said housing members being in the form of a frame; and corrugated elastic strips joining said at least one housing member to said support so that it can oscillate, with said corrugated elastic strips being on an inside surface of said frame and a plate joined to said frame by said corrugated strips and comprising means for attaching said at least one housing member.

13. Housing according to claim 12 wherein said plate comprises fingers and said at least one housing member comprised bushes adapted to cooperate with said fingers.

14. Electrical connector comprising:

a molded plastics material female housing member incorporating a skirt;

a molded plastics material male housing member adapted to be inserted into said skirt;

guide means on one of said male and female housing members for aligning said male and female housing members during insertion of said male housing member into said skirt;

multiple channels in each housing member;

male electrical connection members in said channels of one housing member;

corresponding female electrical connection members in said channels of the other housing member;

a support for at least one of said housing members;

corrugated elastic strips joining said at least one housing member to said support so that it can oscillate therein; and said at least one housing member, said support and said elastic strips being molded in one piece from said plastics material.

15. Connector according to claim 14 further comprising means on said support for fixing it into an opening in a holding member.

16. Connector according to claim 14 wherein said support is in the form of a frame and said corrugated elastic strips are inserted between a side wall of said at least one housing member and an internal side wall of said frame.

17. Connector according to claim 14 wherein said guide means comprise a flared extension of said skirt.

18. Connector according to claim 14 wherein said guide means comprise fingers on one housing member and corresponding bushes on the other housing member.

19. Connector according to claim 18 wherein said fingers have conical ends.

20. Connector according to claim 19 wherein said fingers and conical ends are defined by ribs disposed radially to an axis passing through the tips of sad conical ends.

21. Electrical connector comprising:

a molded plastics material female housing member incorporating a skirt;

a molded plastics material male housing member adapted to be inserted into said skirt;

guide means on one of said male and female housing members for aligning said male and female housing members during insertion of said male housing member into said skirt;

multiple channels in each of said male and female housing members;

male electrical connection members in said channels of one housing member;

corresponding female electrical connection members in said channels of the other housing member;

a support for at least one of said housing members being in the form of a frame;

corrugated elastic strips joining said at least one housing member to said support so that it can oscillate therein, with said corrugated elastic strips being inserted between a side wall of said at least one housing member and an internal side wall of said frame; and said at least one housing member being of a parallelpiped shape, said support having a corresponding shape and said corrugated elastic strips extending between outer corners of said at least one housing member and inner corners of said support.

22. Electrical connector comprising:

a molded plastics material female housing member incorporating a skirt;

a molded plastics material male housing member adapted to be inserted into said skirt;

guide means on one of said male and female housing members for aligning said male and female housing members during insertion of said male housing member into said skirt;

multiple channels in each of said male and female housing members;

male electrical connection members in said channels of one housing member;

corresponding female electrical connection members in said channels of the other housing member;

a support for at least one of said housing members being in the form of a frame;

corrugated elastic strips joining said at least one housing member to said support so that it can oscillate therein, with said corrugated elastic strips being inserted between a side wall of said at least one housing member and an internal side wall of said frame; and said at least one housing member being parallelpiped-shape, said support having a corresponding shape and two corrugated elastic strips extending between mid-points of respective opposite side walls of said at least one housing member

23. Connector according to claim 22 wherein said corrugated elastic strips are V-shape with two branches of unequal length, the shorter branch being joined to said at least one housing member.

24. Connector according to claim 23 further comprising abutment members for limiting movement of said at least one housing member in said support.

25. Electrical connector comprising:

a molded plastics material female housing member incorporating a skirt;

a molded plastics material male housing member adapted to be inserted into said skirt;

guide means on one of said male and female housing members for aligning said male and female housing members during insertion of said male housing member into said skirt;

multiple channels in each housing member;

male electrical connection members in said channels of one housing member;

corresponding female electrical connection members in said channels of the other housing member;

a support for at least one of said housing members being in the form of a frame;

corrugated elastic strips joining said at least one housing member to said support so that it can oscillate therein, with said corrugated elastic strips being on an inside surface of said frame; and a plate joined to said frame by said corrugated elastic strips and comprising means for attaching said at least one housing member.

26. Connector according to claim 25 wherein said plate comprises fingers and said at least one housing member comprises bushes adapted to cooperate with said fingers.

* * * * *